US007065492B2

(12) United States Patent
Cinquini et al.

(10) Patent No.: US 7,065,492 B2
(45) Date of Patent: Jun. 20, 2006

(54) METHOD AND APPARATUS FOR PROVIDING A PERSONAL ITEM DROP OFF/RETURN SERVICE AT SECURITY CHECKPOINTS

(75) Inventors: Laura Cinquini, 1 Vinewood, Ladera, CA (US) 92964; Allen J. McBride, Alexandria, VA (US)

(73) Assignee: Laura Cinquini, Ladera Ranch, CA (US)

( * ) Notice: Subject to any disclaimer, the term of this patent is extended or adjusted under 35 U.S.C. 154(b) by 612 days.

(21) Appl. No.: 10/283,317

(22) Filed: Oct. 30, 2002

(65) Prior Publication Data

US 2004/0010430 A1 Jan. 15, 2004

Related U.S. Application Data

(60) Provisional application No. 60/394,928, filed on Jul. 11, 2002.

(51) Int. Cl.
*G06Q 99/00* (2006.01)

(52) U.S. Cl. ..... 705/1; 705/402; 705/406

(58) Field of Classification Search ..... 705/1, 705/401, 402, 406, 407
See application file for complete search history.

(56) References Cited

U.S. PATENT DOCUMENTS 4,438,868 A 3/1984 Edwards
5,388,049 A 2/1995 Sansone et al.
5,570,290 A * 10/1996 Foschi ..... 705/408
5,586,037 A 12/1996 Gil et al.
5,606,508 A 2/1997 Thiel
6,112,989 A 9/2000 Sheldon
6,178,412 B1 1/2001 Ratzenberger, Jr. et al.
6,390,366 B1 5/2002 Heidenreich et al.
2001/0042055 A1 11/2001 Didriksen et al.
2002/0007281 A1 1/2002 Gil et al.
2003/0226883 A1* 12/2003 Liphard ..... 232/1 R

FOREIGN PATENT DOCUMENTS

EP 0 926 642 A2 6/1999

OTHER PUBLICATIONS

Shadyside, Robert Perloff, Confiscation is not right, Jan. 1, 2002, Pittsburg Post—Gazette, p. A8.*
Seavey, Deborah Turcotte, Knife promotion angers air traveler, Dec. 17, 2001, Bangor Daily News, p. 4.*

(Continued)

*Primary Examiner*—John G. Weiss
*Assistant Examiner*—Jamisue A. Webb
(74) *Attorney, Agent, or Firm*—Oliff & Berridge, PLC

(57) ABSTRACT

An apparatus and method provide a personal item return service to an owner of a personal item that is subject to confiscation before the owner is admitted through a security checkpoint and into a secure area downstream of the security checkpoint. The security checkpoint can be located at a transportation center (airport, bus or train) or any entrance to a secure area at a building or sports arena. The owner can purchase from a vending machine or kiosk a container having sufficient pre-paid postage based on the size or weight of the item, and mail the item to a destination selected by the owner. The service is located adjacent to the security checkpoint so that the owner need not lose his/her place in the security line.

28 Claims, 3 Drawing Sheets

OTHER PUBLICATIONS

Bradley, Sam, USPS Launches First Global Courier Service, Apr. 1, 1996, Brandweek, v XXXVII, n 14, p 18.*
Federal Express: FedEx to Offer Enhancement of International Services, Jun. 3, 1997, Business Wire, Business Editors, Memphis, Tenn. 6:59 PT.*
The Washington Times, Oct. 30, 2002.
The Business Journal of Phoenix, Aug. 22, 2002.
News Release, Aug. 22, 2002.
Security Controlled Items Self Mailer Program, Jun. 4, 2002.
"PIO Staffer Caught in Airport Weapons Search" Jan. 15, 2002; http://www.3ad.us/pio/bulletin.bd/leopold.p38.htm.
Elizabeth Tarnove, "Flying Needles Face Restrictions" Sep. 29, 2001; www.thesophisticatedstitcher.com/art2001/flying.php.

* cited by examiner

METHOD AND APPARATUS FOR PROVIDING A PERSONAL ITEM DROP OFF/RETURN SERVICE AT SECURITY CHECKPOINTS

This application claims priority from U.S. Provisional Application Ser. No. 60/394,928 filed Jul. 11, 2002, the disclosure of which is herein incorporated by reference.

BACKGROUND OF THE INVENTION

1. Field of Invention

The invention relates to methods and apparatus for providing passengers with a convenient and efficient service to return personal items not allowed on commercial transportation systems (such as airplanes, trains and buses) to the owner's home or destination. The invention also relates to methods and apparatus for providing entrants into a secure area (such as buildings, stores and sport arenas) with a service for return of personal items not allowed within the secure area. The service is located at the security checkpoint at which the personal items may be confiscated.

2. Description of Related Art

With heightened airport security, many passengers have personal items, such as scissors, corkscrews, pocket knives or nail clippers, that are subject to confiscation by security personnel at the security checkpoint before boarding an aircraft. Passengers are left with the choice of either surrendering the items to the security personnel for discarding, or risk missing their flight by leaving the line at the security checkpoint to arrange for returning the items to the passenger's home. Passengers on other types of transportation modes, and entrants into a secure area, also face this dilemma.

SUMMARY OF THE INVENTION

The invention is a method and/or apparatus that provides passengers/entrants with the ability to avoid confiscation of certain goods at security checkpoints. Many passengers/entrants have personal effects such as scissors, corkscrews, pocket knives, nail clippers or other property that may be confiscated by security personnel at a security checkpoint before boarding the airplane, train or bus, or entering any type of secure area. The invention allows the passenger/entrant to avoid confiscation and ultimately losing the items by arranging for a service located at the security checkpoint for returning the items to the owner, either to the owner's home or destination. The invention will provide the owner with accessible postage prepaid envelopes of various sizes suitable for mailing the items, as well as a location to drop off the items for pickup.

The invention will be described in relation to airport security, with the passengers passing through an airport security checkpoint/metal detector before boarding an aircraft. However, the invention is applicable to any transportation system, such as railways, bus lines, passenger ships, etc. Further, the invention is applicable to any entrant into a secure area, where the entrant must pass through a security checkpoint before entering the secure area.

Generally, the invention includes a self-service kiosk or vending machine located at the security checkpoint (e.g., at the metal detectors). The kiosk or vending machine provides padded envelopes of various sizes with pre-paid postage previously affixed to the envelope. The pre-paid postage would be in different amounts depending on the weight and/or size of the contents and the desired time-frame in which the items are to be delivered (e.g., overnight, 2-day, etc.).

Without leaving the security checkpoint area (and therefore preferably without losing his/her place in line), the passenger would purchase the appropriate size envelope, address the envelope with the desired destination of the contents (e.g., the passenger's home or destination), and deposit the envelope in a secure holding area in the kiosk or vending machine for pick-up at predetermined times by the package handling vendor for delivery to the intended destination. The purchase price would cover the cost of the envelope, the pre-paid postage, the delivery fees, and any other premiums for the package handling vendor to profitably operate the service.

Conveniently locating the kiosk or vending machine adjacent the security checkpoint allows the traveler to minimize delay at the security checkpoint when dropping off the goods. Therefore, the service is located at a point convenient to passengers either approaching a security checkpoint, currently at a security checkpoint, or immediately past a security checkpoint. The location also recognizes the time sensitive nature of travel and the need to avoid missing a departure time due to security delays. The drop-off point may be a United States postage mail drop-off point or a private delivery service such as UPS or Federal Express.

The service can be provided to the passengers in several ways. One example is a vending machine that will provide envelopes and other necessary materials to the passenger. Another example would be a kiosk possibly staffed by one or more attendants. It is also possible to use a drop-off box with a supply of envelopes, with the delivery charge being subsequently billed to the sender or recipient. The invention contemplates the use of cash, credit/debit cards, or any other means to pay for the service.

The method also contemplates providing the passenger with envelopes, boxes or other means to transport the item. Additionally, these boxes or envelopes may have prepaid postage in order to expedite the process. In an alternative example, the process may also include a scale to weigh the personal items so as to select the appropriate pre-paid postage envelope and/or to weigh the box or envelope so as to provide the exact postage amount.

The method may further include a step of pre-addressing the packages with the passenger's home address or destination already on it. The packages can be pre-addressed by having the user identify himself, either from a scan bar on his plane ticket, or being provided with preprinted address labels when checking into the airport with his ticket. Alternatively, the passenger may simply manually enter his address information at the machine or kiosk. Accordingly, the kiosk or machine will be provided with a scanner or other device for reading the passenger's information in the medium provided. In an additional example of the method, when the passenger pays by credit card, the delivery service may simply address the package with the billing address provided by a credit card company.

The kiosk or vending machine will also have means for selecting the shipping materials and postage, including in one example, a touch screen or, in another example, push-buttons corresponding to the packages to be selected. Additionally, the kiosk or vending machine may present the user with an option to select the type of service to be provided, including preferred delivery schedules and carriers.

In view of the foregoing, the invention allows a passenger to avoid the confiscation of personal items at a security checkpoint when traveling by providing packaging material at the security checkpoint with the ability to drop off the package for a delivery service. The invention enables the passenger to avoid missing a departure time, because the passenger need not lose his/her place in line at the security checkpoint to accommodate the return of the personal items. These and other features and advantages of this invention are described in or are apparent from the following detailed description of the preferred embodiments.

BRIEF DESCRIPTION OF THE DRAWINGS

The invention will be described with reference to the accompanying drawings, in which like elements are labeled with like numbers and in which.

DETAILED DESCRIPTION OF PREFERRED EMBODIMENTS

Figure 1:
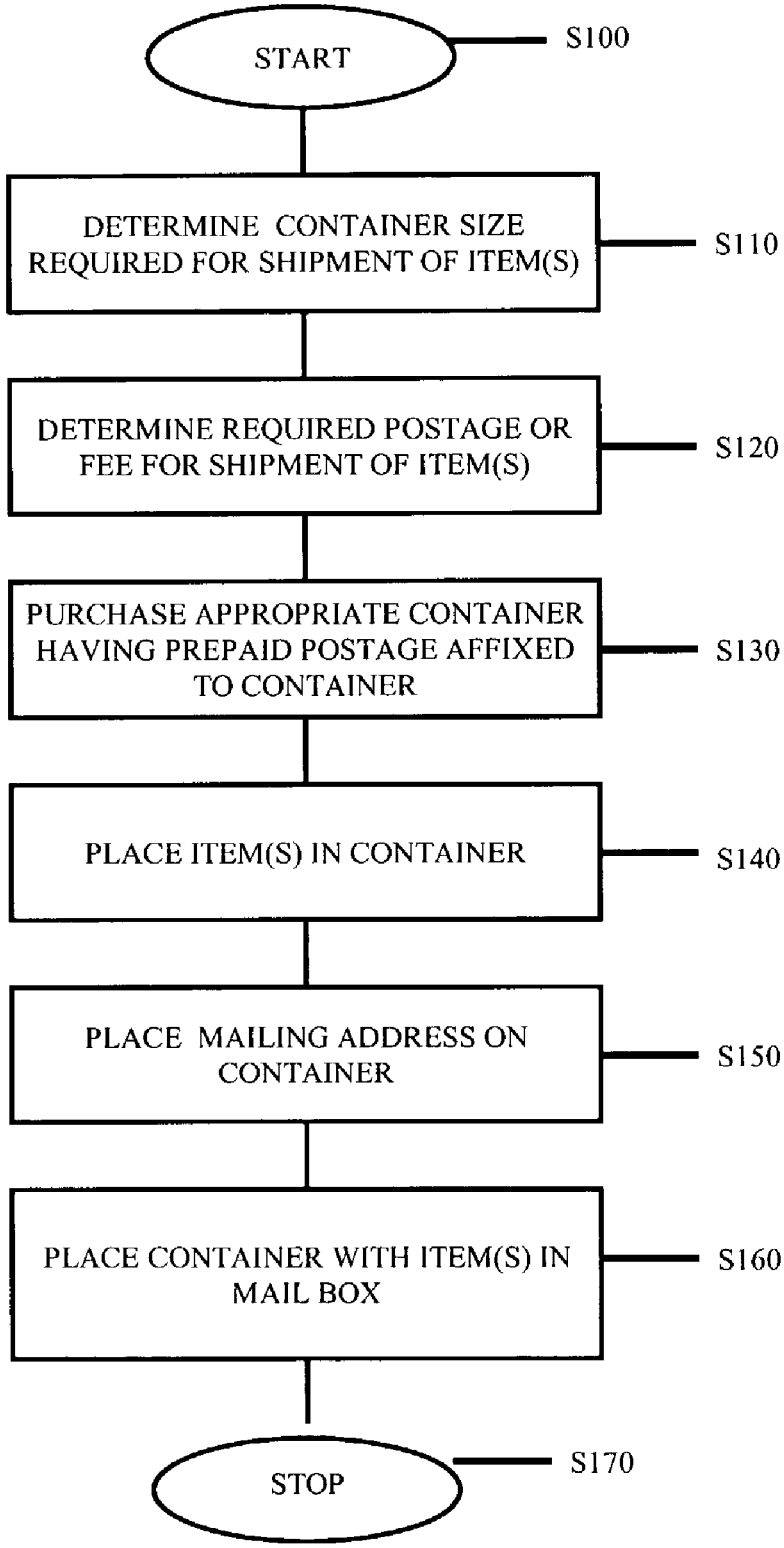
FIG. 1 shows a flowchart for utilizing an exemplary embodiment of the personal item drop-off/return-service of this invention.

FIG. 1 shows a flowchart for utilizing an exemplary embodiment of the personal item drop-off/return-service of this invention. The process begins at step S100 where a passenger determines that they are in possession of an item or items which may prevent them from boarding commercial transportation systems such as airplanes, ships, trains or buses. At this point the passenger would step towards the apparatus of this invention, for example, a kiosk or vending machine, to dispose of the particular item or items not allowed on the commercial transportation system. In this exemplary embodiment the passenger would determine the container size required for shipment of the item or items at step 110. For example, a smaller item such as a pocket knife, fingernail clippers, or cigarette lighter may be placed in an appropriately sized padded envelope. Larger items, may require larger envelopes, or a box or other such rigid container for shipping.

Once the container size has been determined, the user would then determine the required postage or fee for shipment of the item in step 120. In various exemplary embodiments a list of postage or shipping costs corresponding to weights or sizes may be provided at the kiosk or vending machine or other such apparatus to guide the user in determining the required postage or fee. Still in other exemplary embodiments the envelopes or containers may have postage prefixed to the containers. In this case the user would then select the container having sufficient postage based on the size and weight of the item. It should be appreciated that in various exemplary embodiments of the methods and apparatus of this invention, different courier services maybe available in conjunction with the invention. For example, the device may be dedicated to a single courier service, or the user may have the option of selecting between a number of different courier services, such as UPS, Federal Express or the United States Post Office.

Once the correct postage or fee has been determined, the user would purchase the appropriate container having prepaid postage affixed to the container at step 130. It should be appreciated, that in various exemplary embodiments the user may have the option to purchase postage at the device or to use postage that is already in the possession of the user, thus avoiding the need to purchase additional postage. Once the container has been purchased the user would then place the item or items in the container at step 140. The container would then be sealed.

Once the container is sealed the user would then place the mailing address on the container at step S150. It should be appreciated, that in various exemplary embodiments the user may place the mailing address on the container manually by handwriting the address on the container, or in other exemplary embodiments the user may enter the mailing address into the device via a keyboard, for example, and obtain a preprinted label with the mailing address on the label. The label may then be affixed to the container. Yet in other exemplary embodiments the mailing address may be preprinted on the container itself.

Once the item or items has been placed in the container and the mailing address has been affixed on the container, the individual would then place the container in a mailbox or drop-off box at step S160. As discussed previously, the drop-off box may be a common box that is utilized by multiple carrier services or may correspond to an individual courier service such as Fed Ex, UPS or the U.S. Post Office. At step 170 the procedure is complete and the user would then be free to pass through a security checkpoint without having the particular item or items confiscated.

Figure 2:
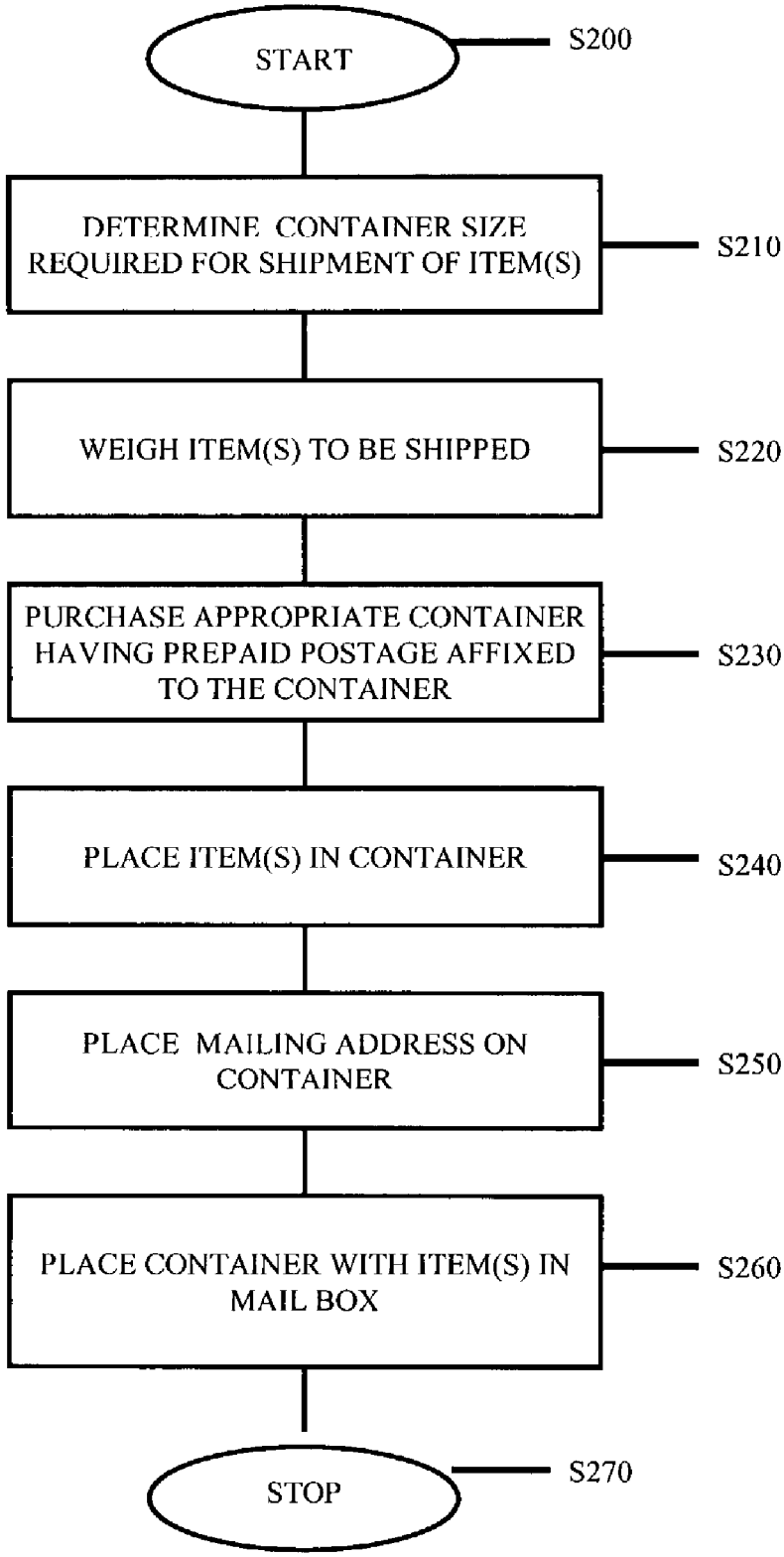
FIG. 2 shows a flow chart for utilizing another exemplary embodiment of the personal item drop-off/return-service according to this invention wherein the item to be shipped may be weighed.

FIG. 2 is an exemplary embodiment of a flowchart for utilizing the personal item drop-off of this invention wherein the item may be weighed. In this exemplary embodiment the user starts at step S200 and then determines the container size required for shipment of the item or items at step 210. In this exemplary embodiment the user has the option of weighing the item or items to be shipped at step S220. For example, in various exemplary embodiments a small scale may be provided at the kiosk or machine for the individual to determine the weight of the item and then select the appropriate postage or fee. In other exemplary embodiments the weight of the item may automatically be processed by a vending machine and the corresponding postage or fee would be indicated to the user. The user would then have the option of deciding whether or not to ship the item.

Once the item has been weighed, the user would then purchase the appropriate container, having prepaid postage affixed to the container at step 230. As discussed previously the user may have the option of placing separately purchased postage on the container. Once the container has been purchased, the item would be placed in the container at step 240. If necessary, the mailing address would then be placed on the container at step 250 and the container with the item or items inside would be placed in the mailbox or courier drop-off box at step 260. At step 270 the process is complete and the user is free to pass through the security checkpoint.

Figure 3:
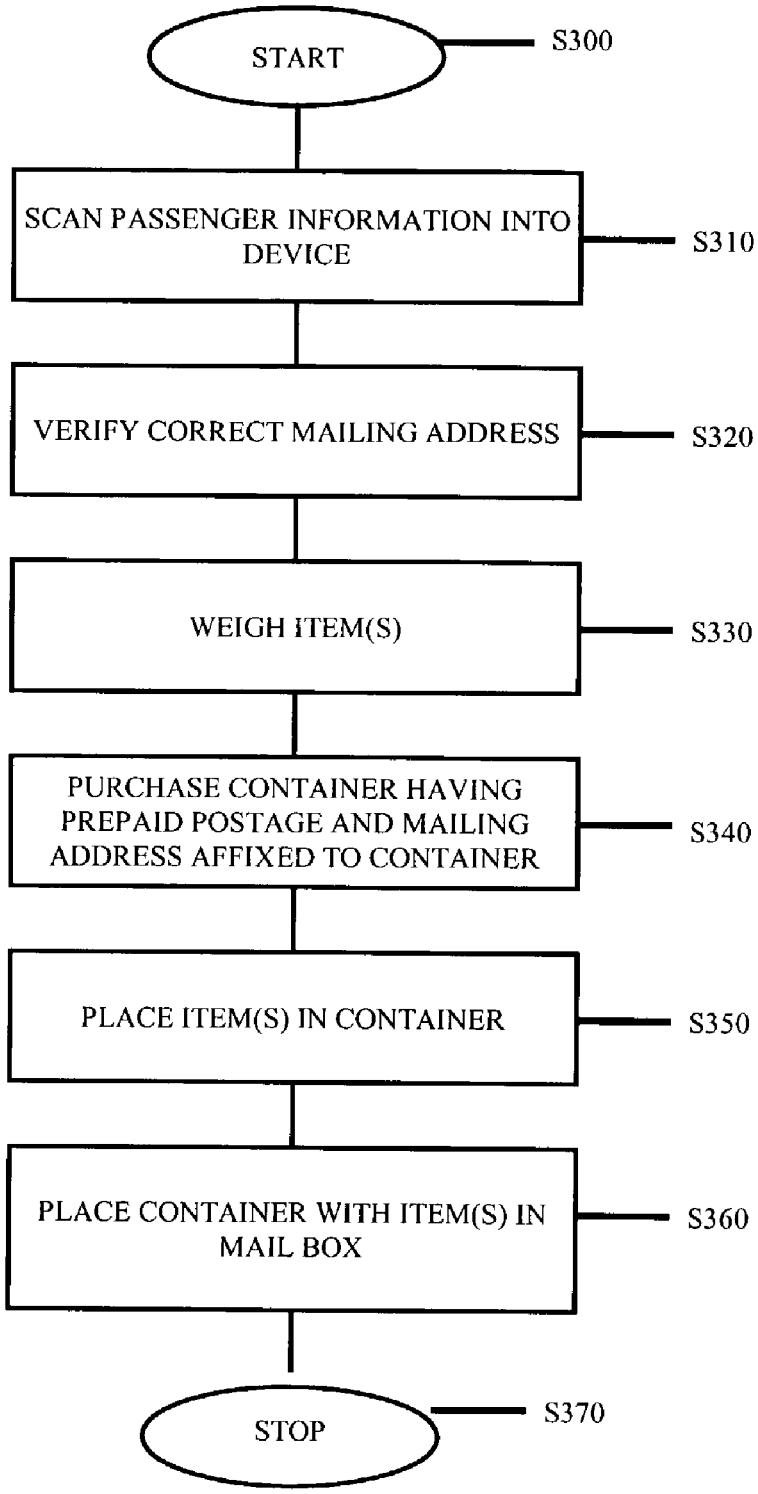
FIG. 3 is a flowchart for utilizing an exemplary embodiment of the personal item drop-off/return-service of this invention wherein passenger information may be scanned into the device.

FIG. 3 is an exemplary embodiment of a flowchart for utilizing the personal item drop-off of this invention wherein the user may scan information into the device. The process starts at step 300 and at step 310 the user would scan their passenger information into the device. In various exemplary embodiments this may be done by using a bar code or other such similar encoding mark located on a ticket to scan information into the device. In other embodiments the user may swipe a credit card or debit card through the vending machine to enter the information into the device. It should be appreciated that in various exemplary embodiments the credit card or debit card may be utilized to pay for the service. In various embodiments the passenger ticket information may correspond to a particular transportation service, such as an airline, railway or cruise line, thus allowing the transportation service to provide its passengers with the use of this invention free of charge, or to include the charge with a passenger's bill. In other exemplary embodiments the user may be billed for the service at a later date.

Once the user has scanned the passenger information into the device they would then verify the correct mailing address at step 320. In various exemplary embodiments this may be done by viewing a computer screen or monitor. In the event the mailing address is incorrect, the user would have the opportunity to enter the correct mailing address via a keyboard. In various exemplary embodiment the initial mailing address may correspond, for example, to the address given to the transportation service or to the billing address for the credit card or debit card.

Once the passenger information has been scanned into the device and the correct mailing address has been verified, the user would then weigh the items at step 330. The user would then purchase the container having the correct prepaid postage and mailing address affixed to the container at step 340 and place the item in the container at step 350. Having completed the previous steps, the user would then place the container with the item or items in a mailbox or courier delivery box at step 360 and the process would be complete at step 370.

While this invention has been described in conjunction with the exemplary embodiments outlined above, it is evident that many alternatives, modifications and variations will be apparent to those skilled in the art. Accordingly, the exemplary embodiments of the invention as set forth above are intended to be illustrative and not limiting. Various changes may be made without departing from the spirit and scope of the invention as defined in the following claims.

What is claimed is:

1. A method for mailing items that may not be allowed to pass through a security checkpoint and into a secure area adjacent to the security checkpoint, comprising:

selecting a desired container for shipment of at least one item based on at least one of an estimated size and weight of the at least one item from a plurality of different sized containers, each container having different pre-paid postage amounts based on at least one of the size of the container and the estimated weight of the at least one item, each differently sized container having a different sales price;

purchasing the desired container at a location adjacent to the security checkpoint;

placing the at least one item in the container;

placing a mailing address on the container; and placing the container in a courier drop-off box located adjacent to the security checkpoint.

2. The method of claim 1, wherein the desired container is purchased from a kiosk.

3. The method of claim 1, further comprising the step of weighing the at least one item to determine the desired container having sufficient pre-paid postage.

4. The method of claim 1, wherein the container and a service of delivering the container are provided by a commercial courier service.

5. The method of claim 1, wherein the desired container is purchased from a vending machine.

6. The method of claim 5, further comprising the step of scanning information into the vending machine with at least one of a credit card, a debit card and a passenger ticket.

7. The method of claim 6, wherein the information is at least one of a mailing address for the at least one item and a billing address.

8. The method of claim 1, wherein at least one of selecting and purchasing the desired container occurs upstream of the security checkpoint.

9. The method of claim 1, wherein at least one of selecting and purchasing the desired container occurs downstream of the security checkpoint.

10. The method of claim 1, wherein at least one of selecting and purchasing the desired container occurs within the secure area.

11. An apparatus for mailing items that may not be allowed to pass through a security checkpoint and into a secure area adjacent to the security checkpoint, comprising:

a container dispensing element adjacent to the security checkpoint, the container dispensing element containing a plurality of different sized containers based on at least one of an estimated size and weight of the item to be mailed, each container having different pre-paid postage amounts based on at least one of the size of the container and the estimated weight of the item to be mailed, each differently sized container having a different sales price;

a purchasing element adjacent to the security checkpoint that allows a user to purchase a desired container from the container dispensing element;

a selection element adjacent to the security checkpoint that allows the user to select the desired container from the plurality of different sized containers and activate the container dispensing element to dispense the desired container when the purchasing element has confirmed payment of the sales price corresponding to the desired container; and a drop-off box adjacent to the security checkpoint that allows the user to drop off the container for subsequent pick-up and delivery to a desired destination selected by the user.

12. The apparatus of claim 11, wherein the container is one of a box, a tube, an envelope and a padded envelope.

13. The apparatus of claim 11, further comprising a weighing element adjacent to the security checkpoint, for weighing the at least one item to determine proper postage.

14. The apparatus of claim 11, further comprising a scanner adjacent to the security checkpoint, for scanning information into the apparatus with at least one of a credit card, a debit card and a passenger ticket.

15. The apparatus of claim 14, wherein the information is at least one of a mailing address for the at least one item and a billing address.

16. The apparatus of claim 11, wherein the container and a service for delivering the container are provided by a commercial courier service.

17. The apparatus of claim 11, wherein the container dispensing element, the selection element, and the purchasing element, are provided in a vending machine.

18. The apparatus of claim 11, wherein the container dispensing element, the purchasing element, the selection element, and the drop-off box are located adjacent to the security checkpoint and before the secure area at positions that allow the user to maintain the user's place in line for admittance through the security checkpoint.

19. The apparatus of claim 11, wherein the container dispensing element, the purchasing element, the selection element, and the drop-off box are located upstream of the security checkpoint.

20. The apparatus of claim 11, wherein the container dispensing element, the purchasing element, the selection element, and the drop-off box are located downstream of the security checkpoint.

21. The apparatus of claim 11, wherein the container dispensing element, the purchasing element, the selection element, and the drop-off box are located within the secure area.

22. A method for providing a personal item return service to an owner of a personal item, which may be subject to confiscation as the owner passes through a security checkpoint for entry into a secure area adjacent to the security checkpoint, the method comprising:

providing to the owner, adjacent to the security checkpoint, a a plurality of different sized containers, each container having different pre-paid postage amounts based on at least one of a size of the container and an estimated weight of the personal item to mail the personal item to a destination selected by the owner allowing a selection of a desired container from among the plurality of different sized containers; and accepting the desired container into a storage area for subsequent pick-up and delivery of the container to the selected destination, the storage area being located adjacent to the security checkpoint.

23. The method of claim 22, wherein the storage area is located upstream of the security checkpoint.

24. The method of claim 22, further comprising selling the desired container having the pre-paid postage to the owner.

25. The method of claim 22, wherein the owner is provided with the desired container downstream of the security checkpoint.

26. The method of claim 22, wherein the owner is provided with the desired container downstream of the security checkpoint.

27. The method of claim 26, further comprising allowing the owner to maintain the owner's place in line for entrance into the secure area while providing the desired container and accepting the desired container into the storage area.

28. The method of claim 22, wherein the owner is provided with the desired container within the secure area.

* * * * *